US005855545A

United States Patent [19]

Kishi et al.

[11] Patent Number: 5,855,545

[45] Date of Patent: Jan. 5, 1999

[54] CENTRIFUGE CONTAINMENT SYSTEM

[75] Inventors: Kenneth Kishi, Cupertino; Trung Thanh Tu, San Jose; Winston H. H. Lowe, Sunnyvale, all of Calif.

[73] Assignee: Beckman Coulter, Inc., Fullerton, Calif.

[21] Appl. No.: 961,547

[22] Filed: Oct. 30, 1997

Related U.S. Application Data

[63] Continuation of Ser. No. 719,957, Sep. 24, 1996, abandoned.

[51] Int. Cl.[6] ..... B04B 7/06

[52] U.S. Cl. ..... 494/12; 494/60

[58] Field of Search ..... 494/12, 16–21, 494/33, 38, 39, 60, 61, 85

[56] References Cited

U.S. PATENT DOCUMENTS

| | | | |
|---|---|---|---|
| 3,148,146 | 9/1964 | Asnes et al. | 494/16 X |
| 3,322,338 | 5/1967 | Stallman et al. | 494/60 X |
| 3,339,836 | 9/1967 | Mitchell et al. | 494/16 |
| 3,420,437 | 1/1969 | Blum et al. | 494/20 |
| 3,804,324 | 4/1974 | Sinn et al. | 494/60 X |
| 3,819,111 | 6/1974 | Romanauskas et al. . | |
| 3,901,434 | 8/1975 | Wright . | |
| 4,193,536 | 3/1980 | Kubota | 494/61 X |
| 4,196,844 | 4/1980 | Jacobson . | |
| 4,202,487 | 5/1980 | Edwards . | |
| 4,221,325 | 9/1980 | Kubota | 494/16 X |
| 4,484,906 | 11/1984 | Strain | 494/16 |
| 4,764,162 | 8/1988 | Romanauskas | 494/39 X |
| 5,484,381 | 1/1996 | Potter | 494/12 |

*Primary Examiner*—Charles E. Cooley
*Attorney, Agent, or Firm*—William H. May; P. R. Harder; Thomas Schneck

[57] ABSTRACT

A centrifuge having a housing defining a chamber features a containment system with a decelerator to reduce the kinetic energy of debris traveling from the chamber toward the housing. The chamber includes an opening, and a lid is pivotally mounted to the housing to selectively cover the opening. The decelerator includes a first annular member extending from a periphery of the opening inwardly toward the chamber, terminating in a downwardly extending angled region, as well as a second annular member extending downwardly in spaced relation with respect to the housing, forming a gap therebetween. The second annular member, the first annular member and the annular gap define a trap adapted to preventing debris from impinging upon the gasket and the lid. An annular baffle extends downwardly from the lid and is adapted to seat proximate to the trap upon the lid being positioned to cover the opening.

19 Claims, 9 Drawing Sheets

CENTRIFUGE CONTAINMENT SYSTEM

This application is a continuation application Ser. No. 08/719,957 filed on Sep. 24, 1996 now abandoned.

TECHNICAL FIELD

The present invention pertains to the field of centrifuges. Specifically, the present invention pertains to a containment system for centrifuges.

BACKGROUND ART

In centrifuges, a sample solution is attached to a rotor that is spun at high rotational speeds to centrifugally separate the components based upon differences in molecular weight. Centrifugal force is dependent upon the mass of the component, the rotational speed of the rotor and the distance of the sample solution from the rotational axis.

A principal goal in the design of centrifuge systems is directed toward improving the separation/sedimentation of sample components. This typically requires increasing the centrifugal force experienced by the sample, necessitating increased rotational speed or rotor size. However, as the centrifugal force increases, the ability to contain the sample decreases.

For example, as discussed in U.S. Pat. No. 3,819,111 to Romanauskas et al., while undergoing centrifugation, seals of receptacles containing samples may become compromised, resulting in liquid emerging therefrom and filling the centrifuge housing. To retain the liquid, a cover is disposed over the rotor which includes a downwardly depending skirt having a portion which seats against a peripheral rim of the rotor. The cover includes an outwardly facing shoulder, facing a surface of the rotor having a complementary shape. The surface of the cover, positioned opposite to the shoulder, is angled to extend upwardly and outwardly away from the center of the rotor, defining an angled member. An outwardly facing peripheral groove is formed in the angled member which is adapted to receive an O-ring. The O-ring presses against the rotor upon tightening of the cover on the same. During centrifugation, the cover presses downwardly against the rotor, increasing the seal between the cover and the rotor. Disposed in the cover, opposite to the angled member, is a recess in which liquid from the receptacles is contained during centrifugation.

U.S. Pat. No. 3,901,434 to Wright discloses a lid seal for centrifuge rotors, having receptacles therein, which overcomes the drawback of Romanauskas et al. The cover includes, inter alia, a fluid release opening to form what amounts to a pressure relief valve. The release opening communicates with a seal-ring groove in the cover and guards against possible expulsion of the seal ring from the seal-ring groove in the event that one or more of the containers should rupture. This also reduces the fluid pressure acting upon the cover, thereby reducing the probability that the same would bend the cover upwardly away from the receptacles.

U.S. Pat. No. 4,202,487 to Edwards discloses a rotor lid comprising, inter alia, a flat circular disc having a thicker outer perimeter which is designed to mate with the outer perimeter of the rotor. The rotor has an annular recess between a central raised portion and an outer raised perimeter area. The lid utilizes a depending threaded stud to engage a threaded aperture centered on the rotor. An O-ring is located between the outer raised perimeter area of the rotor and the enlarged rim of the lid. The configuration of the enlarged rim on the lid results in a downward force on the O-ring during centrifugation, holding the same in place.

U.S. Pat. No. 4,484,906 to Strain discloses a shell type centrifuge rotor including, inter alia, an upper shell and a lower shell, both of which are connected to a central hub disposed therebetween. The upper shell has a substantially frustoconical shape and a recessed top surface. The top surface has a form generally corresponding to the interior of an inverted frustum. A plurality of samples are disposed in a circular locus in the top of the rotor. The lower shell of the rotor has a bottom formed with upturned inwardly sloping conical sides so that, even if a tube ruptures, the contents of the tube will be retained in the lower shell.

U.S. Pat. No. 5,484,381 to Potter discloses a rotor adapted for use in a non-evacuated chamber that includes, inter alia, a plurality of liquid-capturing holes, each of which includes an opening. Each opening lies radially outboard of a circular locus defined by points on each of the plurality of container-receiving cavities formed in the rotor.

U.S. Pat. No. 4,196,844 to Jacobson discloses a closing structure for an evacuated centrifuge chamber including, inter alia, a door which is slidable horizontally toward and away from a closed position and a retaining member disposed above the door. The retaining member limits upward movement of the door. A side member surrounds the closed door on three sides to contain shrapnel that results from rotor failure. A flange extends downwardly from the door on the remaining side to prevent shrapnel from traveling through the lid-housing interface, thereby preventing shrapnel from exiting the centrifuge.

The aforementioned centrifuges are typically directed toward containing liquid matter within the rotor and are not directed toward containing both particulate, such as shrapnel, and liquid matter within the centrifuge system. This represents a major drawback with the prior art centrifuge designs, because many countries require centrifuges to control the distance that both particulate and liquid matter can travel from the centrifuge when the rotor fails. For example, in the *International Electrotechnical Commission, Safety Requirements for Electrical Equipment for Measurement, Control, and Laboratory Use*, 1010-2-020 (1st ed. 1992), a centrifuge must prevent penetration by shrapnel upon initial and subsequent impact. Shrapnel larger than 1.5 mm in size must not escape through the lid-housing interface, and shrapnel and liquid less than 1.5 mm in size must not travel over 300 mm from the centrifuge.

It is an object, therefore, of the present invention to provide a lightweight containment system for a centrifuge capable of reducing the amount of both liquid and shrapnel that escapes from the centrifuge housing in the event of rotor failure.

SUMMARY OF THE INVENTION

The above object has been met with a centrifuge that includes a housing disposed about a chamber which features a containment system having a decelerator to reduce the kinetic energy of shrapnel, particles and liquid traveling from the chamber toward the housing. For purposes of this invention, shrapnel is defined as solid debris having an area greater than 1.5 $mm^2$ and particles are defined as solid debris having an area less than 1.5 $mm^2$. The housing includes a rectangular bottom wall, a rectangular back plate, a front panel, and a cowling. The back plate and the bottom wall extend along orthogonal planes, with one end of the back plate being connected to the bottom wall. Disposed opposite to the back plate, and extending from the bottom wall, is the front panel. The cowling includes a planar member that extends parallel to the bottom wall. An opening is formed in the planar member so as to be located opposite to the bottom wall, with the opening having a periphery. A side portion is disposed at each end of the planar member and extends toward the bottom wall, forming the side walls of the housing. A pair of hinges are attached between a lid and the back plate, with the lid pivotally mounted to selectively cover the opening.

The containment system includes a gasket positioned proximate to the periphery of the housing to form a substantially fluid-tight seal between the lid and the periphery. The decelerator includes an annular member extending, from the periphery, inwardly toward the chamber transverse to the housing, terminating in an angled member; an annular baffle extending from the lid; and an annular barrier. The angled member extends toward the bottom wall in spaced relation with respect to the housing forming a gap therebetween. The annular member, the angled member and the gap define a trap which reduces the amount of shrapnel, particles and liquid, traveling away from the bottom wall, that impinges upon the sealing member and the lid. The annular baffle extends downwardly from the lid towards the bottom wall, with the baffle adapted to seat proximate to the trap when the lid covers the opening. The annular barrier extends from the periphery downwardly away from the opening, between the angled member and the housing.

BEST MODE FOR CARRYING OUT THE INVENTION

Figure 1:
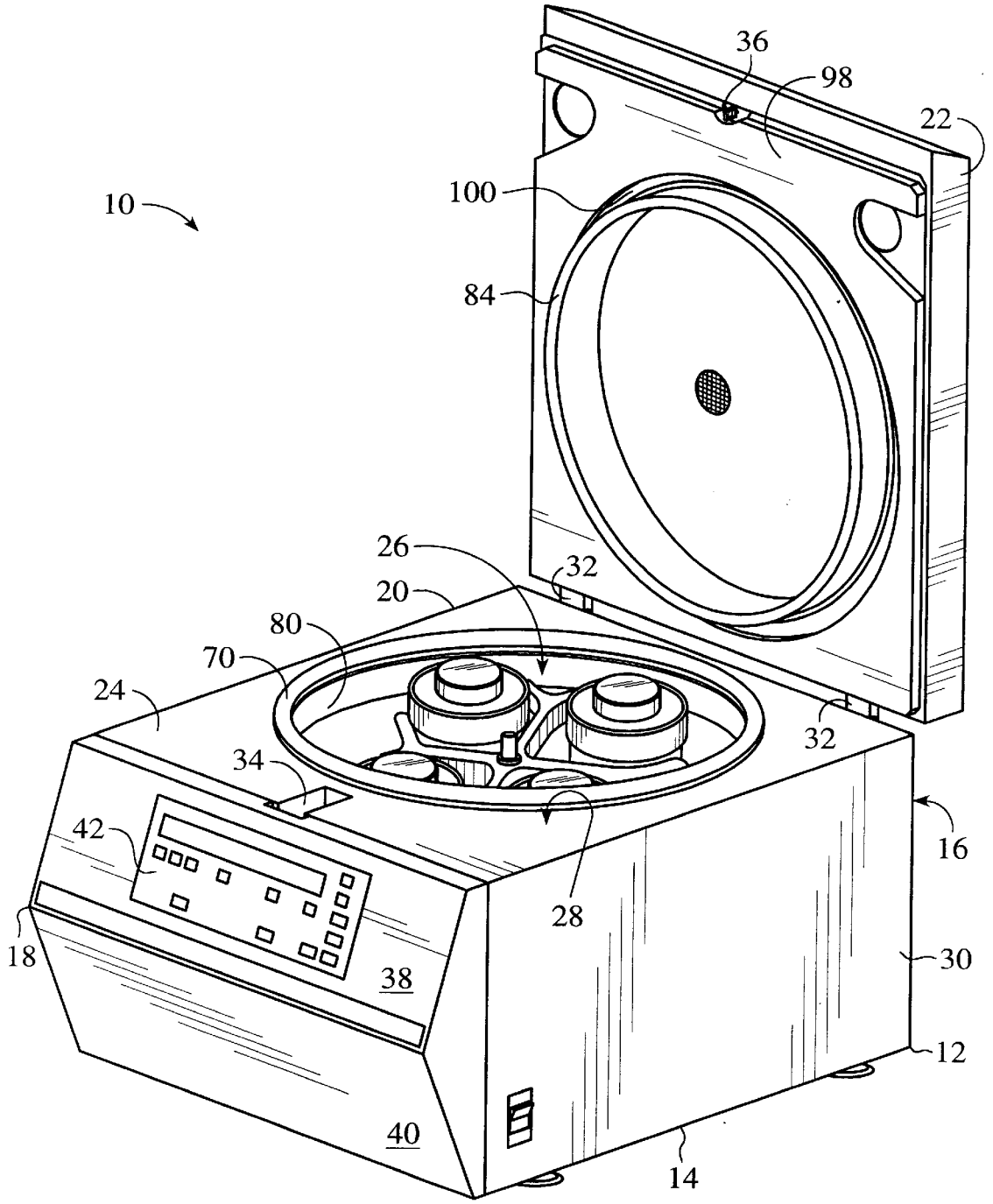
FIG. 1 is a perspective view of a centrifuge in accord with the present invention.

Referring to FIG. 1, a non-evacuated centrifuge 10 includes a generally rectangular housing 12 and a lid 22. Housing 12 includes a rectangular bottom wall 14, a rectangular back plate 16, a front panel 18, and a cowling 20. Back plate 16 and bottom wall 14 extend along orthogonal planes, with one end of back plate 16 being connected to bottom wall 14. Disposed opposite to back plate 16, and extending from bottom wall 14, is front panel 18. Cowling 20 includes a planar member 24 that extends parallel to bottom wall 14. An opening 26 is formed in planar member 24 so as to be located opposite to bottom wall 14, with the opening having a periphery 28, shown more clearly in FIG. 2.

Referring again to FIG. 1, a side portion 30 is disposed at each end of planar member 24 and extends toward bottom wall 14, forming the side walls of housing 12. A pair of hinges 32 are attached between lid 22 and back plate 16, with lid 22 pivotally mounted to move between a final seating position, covering opening 26, and an open position. A latching mechanism 34 is disposed proximate to front panel 18 to cooperatively engage a lever 36, extending from lid 22, to securely fix lid 22 in the final seating position. Front panel 18 includes an upper surface 38 and a lower surface 40. Upper surface 38 extends from planar member 24, at an oblique angle, toward bottom wall 14. Lower surface 40 extends from bottom wall 14, at an oblique angle, toward planar member 24. A control panel 42 is disposed in upper surface 38 of front panel 18.

Figure 2:
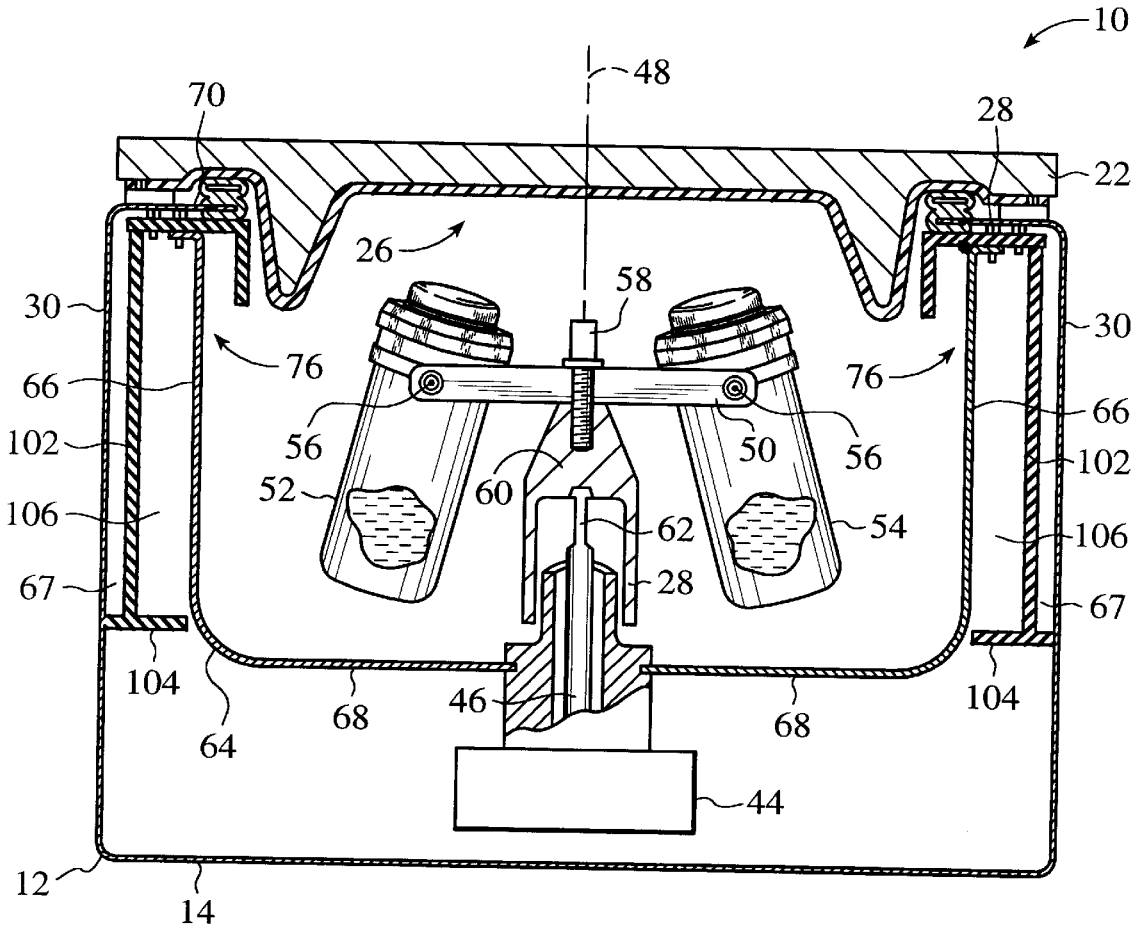
FIG. 2 is a side sectional view of the centrifuge shown in FIG. 1.

Referring also to FIG. 2, disposed within housing 12 is a drive motor 44 for rotating a drive shaft 46 about an axis 48. A swinging-bucket rotor 50 supports buckets with specimen containers inside, shown generally as 52 and 54, for the centrifugal separation of components of a sample within the containers. Containers 52 and 54 are pivotally attached to rotor 50 to rotate about an axis 56 that extends orthogonally to axis 48. A bolt 58 extends through a hole in rotor 50 and is received within an internally threaded bore of a hub 60. Bolt 58 secures rotor 50 to hub 60. Hub 60 is adapted for connection to any of a variety of models of rotors. In this fashion, the rotational drive of motor 44 is transferred to rotor 50 by means of drive shaft 46 and hub 60. Upper end 62 of drive shaft 46 may be secured to hub 60 using conventional techniques. Rotor 50 has an internal surface configured to receive hub 60.

Figure 3:
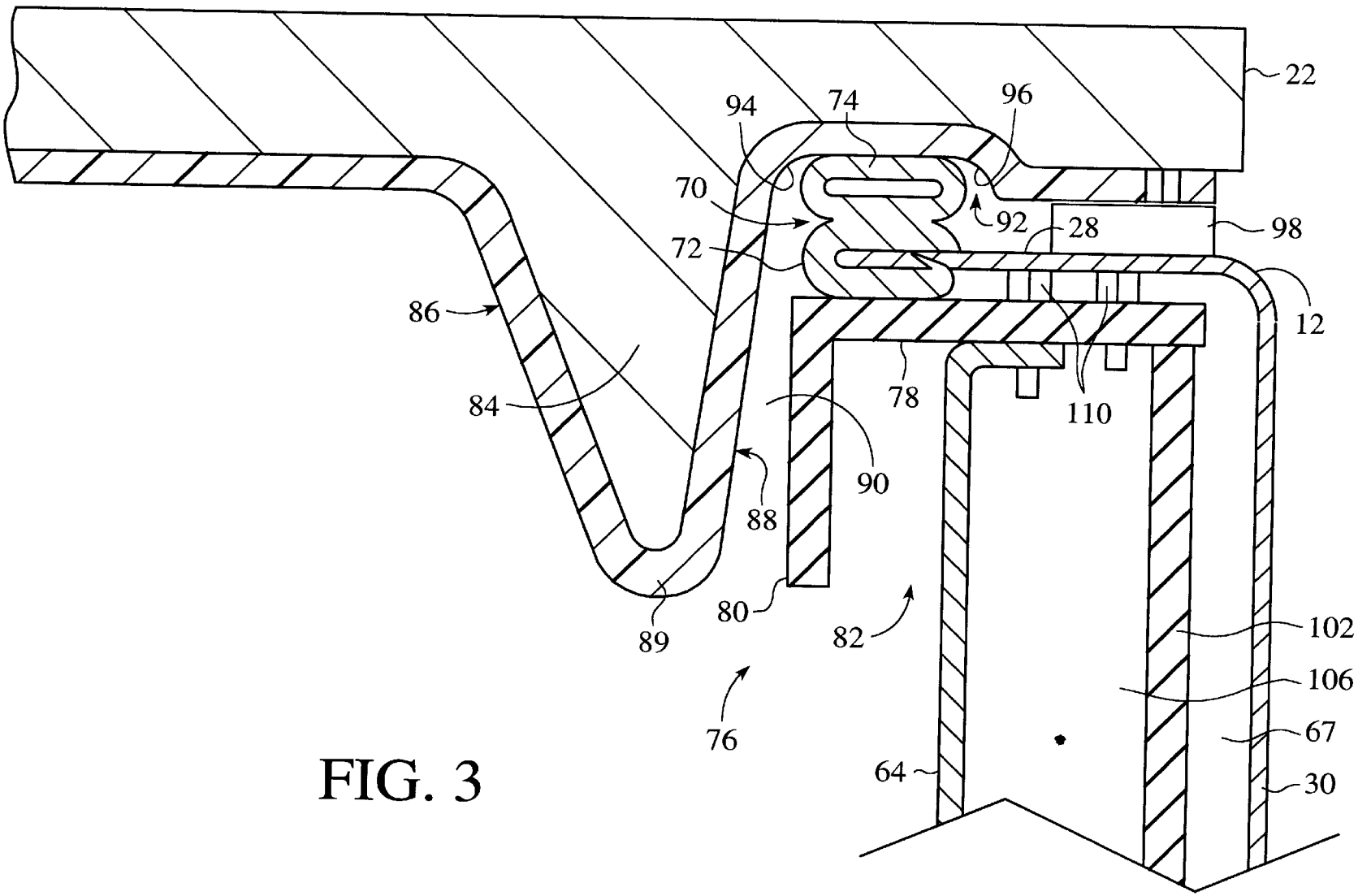
FIG. 3 is a detailed view of a trap which comprises a part of the containment system shown in FIG. 2.

Referring to FIGS. 2 and 3, a bowl 64 is positioned in opening 26 and includes a side portion 66 extending from periphery 28 between housing 12, or more particularly, side walls 30 and rotor 50. A terminus 68 of bowl 64 is positioned opposite to opening 26, between bottom wall 14 and rotor 50. A sealing member, such as a gasket 70, is disposed proximate to periphery 28 to form a substantially fluid-tight seal between lid 22 and periphery 28, upon lid 22 reaching the final seating position. Although any type of gasket may be used, it is preferred to use TRIMSEAL® which includes a metal reinforced rubberized clip 72 integrally formed with a tubular member 74. Clip 72 is securely fastened to periphery 28 with tubular member 74 facing lid 22.

A problem solved by the present invention is providing a light-weight containment system that prevents debris, produced by rotor failure, from exiting housing 12. To that end, the present invention is directed to containing rotor fragments, or shrapnel, that shatters into high energy particles, as well as fluid. It was discovered that rotor fragments typically impact upon lid 22, proximate to gasket 70, compromising the seal between lid 22 and periphery 28. Specifically, during operation, rotor 50 looses the ability to hold one or more of containers 52 or 54, resulting in one of the same coming loose, impacting with side portion 66. The impact with side portion 66 typically causes the container to rupture, spilling the sample into bowl 64. If glass, or other fragile material is present, in the containers, this material disintegrates, spewing shrapnel and particles throughout bowl 64. Exacerbating the problem is the rotation of rotor 50 which causes the remaining containers to repeatedly strike against the container that came loose from rotor 50. This produces additional shrapnel and particles which break loose from both the containers and the rotor 50. The combined force of the shrapnel, particles and liquid tends to lift lid 22 away from opening 26.

To shield the lid-periphery seal, a trap 76 is formed which protects the lid-periphery seal from shrapnel, particles and liquid traveling upwardly from rotor 50. Trap 76 includes an annular member 78, extending from periphery 28 inwardly toward axis 48, transverse to side walls 30, terminating in an angled member 80. Typically, annular member 78 extends perpendicular to housing 12 and side walls 30 and is located between gasket 70 and rotor 50. Angled member 80 extends, perpendicular to annular member 78, toward bottom wall 14 in spaced relation with respect to housing 12, forming a gap 82 therebetween. Shrapnel, particles and liquid travelling into gap 82 are decelerated upon impact with annular member 78 and angled member 80, and then are deflected away from the lid-periphery seal. In this fashion, trap 76 protects the lid-periphery seal from shrapnel, particles and liquid traveling along the outer diameter of bowl 64, with some of the shrapnel, particles and liquid being trapped in gap 82. It is preferred that trap 76 be formed from either steel or composite material, such as KEVLAR®. This provides the additional benefit of reducing the force experienced by lid 22, thereby reducing the probability that lid 22 will move away from opening 26.

Additional protection to the lid-periphery seal is provided by an annular baffle 84 depending from lid 22, so as to be located proximate to trap 76, upon lid 22 reaching the final seating position. In the final seating position, an inner surface 86 of annular baffle 84 extends from lid 22 angled outwardly away from axis 48 toward bottom wall 14. An outer surface 88 extends from lid 22 toward bottom wall 14, substantially parallel to angled member 80. Inner surface 86 is attached to outer surface 88, forming a base 89 of baffle 84. Preferably, annular baffle 84 extends coextensive with angled member 80 and mates closely thereto leaving only a narrow channel 90 defined between outer surface 88 and angled member 80. Narrow channel 90 is in fluid communication with gasket 70. Baffle 84 serves to protect the lid-periphery seal from debris originating from points in bowl 64 radially distant from axis 48, by minimizing the area of channel 90, discussed more fully below. Inner surface 86 protects the lid-periphery seal from shrapnel, particles and liquid travelling from points in bowl 64, proximate to axis 48, by deflecting the same downwardly toward bottom wall 14. To that end, baffle 84 may be formed from any material capable of absorbing a great amount of energy associated with debris that impacts with it. This allows baffle 84 to decelerate the debris and deflect the same without baffle 84 being penetrated. Preferably, baffle 84 is created from a vacuum formed plastic sheet which is attached to the underside of lid 22 using conventional techniques.

Referring to FIGS. 1 and 3, disposed adjacent to baffle 84, and formed in the same plastic sheet, is an annular recess 92. Annular recess 92 forms an inner shoulder 94 and an outer shoulder 96. Inner shoulder 94 is disposed adjacent to baffle 84, with outer perpendicular shoulder 96 being disposed opposite thereto. Annular recess 92 is positioned to receive gasket 70 when lid 22 covers opening 26. A lid skirt 98 is formed by attaching a foam sheet to the underside of lid 22. The foam sheet includes a central aperture 100, the perimeter of which is positioned concentrically about both baffle 84 and recess 92. Lid skirt 98 seats between lid 22 and planar member 24 upon lid 22 reaching the final seating position. In this fashion, lid skirt 98 surrounds periphery 28 and gasket 70.

The narrow width of channel 90 decelerates shrapnel, particles and liquid moving therethrough by increasing the path of resistance to the same, traveling towards the lid-periphery seal. Debris reaching the lid-periphery seal, thus, has a substantial decrease in energy as compared to the energy of the same when emanating from rotor 50. Should the lid-periphery seal be compromised, inner shoulder 94 and outer shoulder 96 both function to further decelerate debris traveling therethrough, thereby further dissipating the energy of the same. This results from the substantial number of ricochets the debris would have to undergo to navigate the sharp turns necessary to exit centrifuge 10. Finally, lid skirt 98 blocks debris which successfully navigates past inner shoulder 94 and outer shoulder 96. Typically, debris, reaching lid skirt 98, has lost a substantial amount of energy so that the probability of penetration through lid skirt 98 is minimized.

Referring to FIGS. 2 and 3, to provide greater resistance against shrapnel penetrating housing 12, an annular barrier 102 is disposed to extend from periphery 28 toward bottom wall 14, between side portion 66 and housing 12. Annular barrier 102 terminates in an annular flange 104, positioned proximate to terminus 68. Annular flange 104 extends between housing 12 and side portion 66. It is preferred that annular barrier 102 be spaced apart from both side portion 66 and housing 12. In this fashion, an annular gap 106 is formed between barrier 102 and side portion 66. A gap 67 is present between barrier 102 and side walls 30. Annular barrier 102, similar to trap 76, is formed from a material that is capable of absorbing a tremendous amount of energy from shrapnel traveling radially from axis 48 toward housing 12. To that end, it is preferred that annular barrier 102 be formed from steel or a composite material, such as KEVLAR®.

During system failure, shrapnel puncturing side portion 66 would travel into annular gap 106 and experience a reduction in kinetic energy due to impact with side portion 66. In addition, the trajectory of shrapnel puncturing side portion 66 is altered due to deflection, causing the same to take a longer path of travel before impacting with annular barrier 102. This also reduces the kinetic energy of the shrapnel. Upon impact, shrapnel transfers a substantial amount of its kinetic energy to annular barrier 102. It is preferred that annular barrier 102 is constructed to be semi-rigid so as to plastically deform upon impact by the shrapnel. This allows barrier 102 to decelerate shrapnel by absorbing the kinetic energy associated with it while preventing both penetration of barrier 102 and creation of additional shrapnel. Annular flange 104 serves to maintain the spaced apart relation of barrier 102 from side wall 30.

Annular flange 104 is formed from a flat strip of metal which is spot welded to barrier 102, forming a "T" joint with barrier 102. The hoop strength of flange 104, coupled with the "T" joint, substantially stiffens the lower end of barrier 102, thereby preventing the same from stretching, or elongating, so as to narrow gap 67 and come into contact with housing 12. In this fashion, annular barrier 102 is formed to be relatively light-weight, while preventing shrapnel from penetrating housing 12. Thus, the containment system is suitable for table-top centrifuge devices which must typically be light-weight and portable. It is to be understood that either trap 76, annular baffle 84 or barrier 102 may be used together, which is the preferred embodiment discussed above, or alone. In this fashion, centrifuge 10 may include only trap 76, without annular baffle 84 or annular barrier 102. Alternatively, trap 76 may be included with baffle 84, while omitting barrier 102; or, centrifuge 10 may include annular barrier 102, while omitting baffle 84. Baffle 84 and annular barrier 102 may be included in centrifuge 10, absent trap 76.

Figure 4:
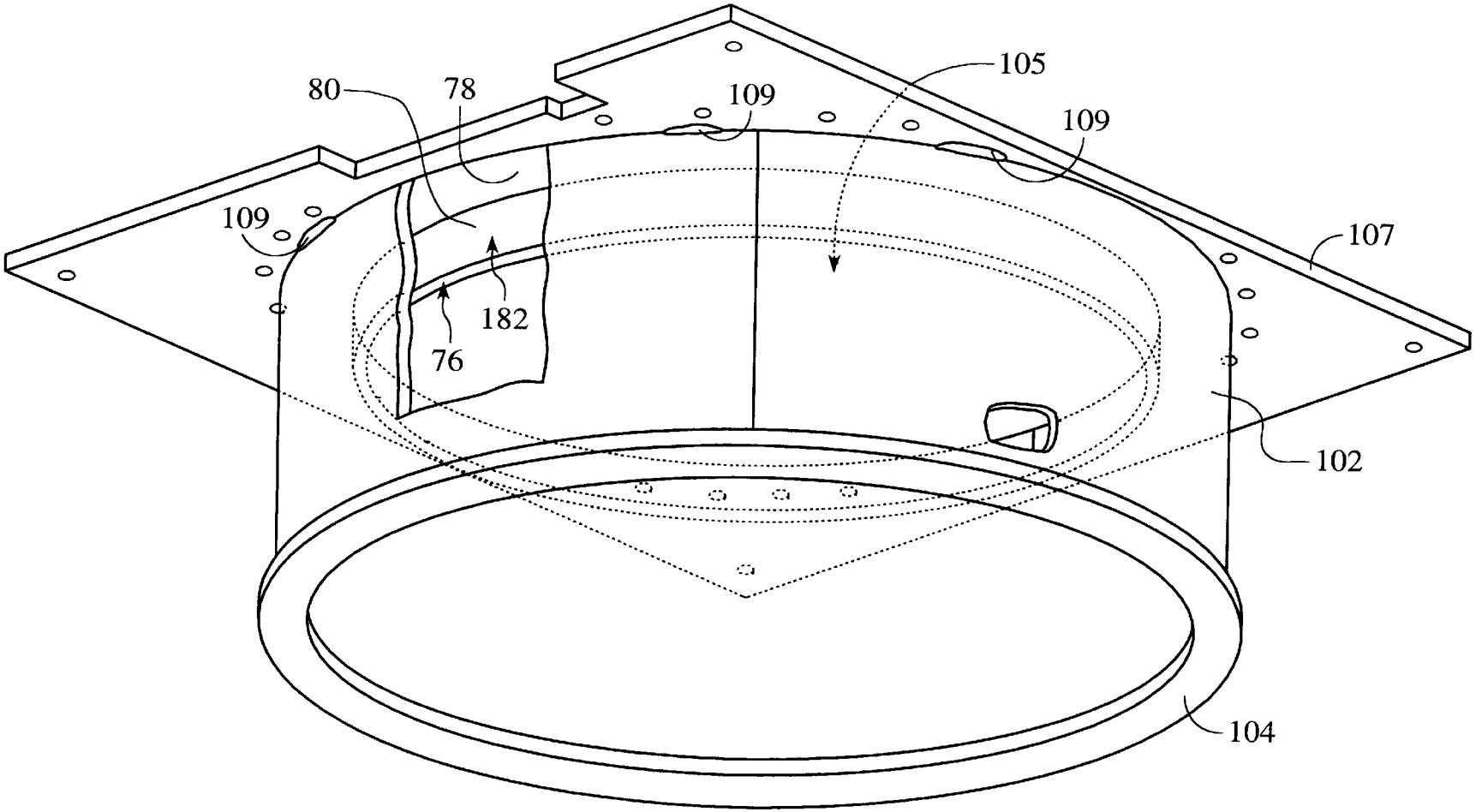
FIG. 4 is a perspective view of a trap and barrier of the containment system shown in FIG. 2, in accord with a preferred embodiment.

Referring to FIGS. 2 and 4, in the preferred embodiment, trap 76 and annular barrier 102 are formed as a single unit to be inserted into centrifuge 10, thereby making trap 76 and barrier 102 suitable to be added to existing centrifuge systems. Angled member 80 is formed by bending a perimeter at an opening 105 disposed within a metal plate 107. Annular member 78 is defined by the portion of metal plate 107 which is circumferentially disposed about opening 105. In this fashion, metal plate 107 is integrally formed with trap 76. One end of annular barrier 102 is welded to top plate 107 at various points around the perimeter, shown at points 109. Annular barrier 102 extends from top plate 107 past angled member 80, defining an annular gap 182 therebetween. Annular flange 104 is attached to an end of barrier 102, opposite to top plate 107. Flange 104, however, is not necessary, and annular barrier 102 may be formed without it. For example, annular barrier 102 may be substantially thick so as to rest against housing 12 when positioned therein. In this fashion, annular barrier 102 may be formed of a heavy gauge metal to function as an armor plate, preventing debris from Referring to FIGS. 3 and 4, trap 76 and barrier 102 are attached to housing 12 by attaching metal plate 107 to an underside of periphery 28 with bolts 110. Side portion 66 of bowl 64 is disposed in annular gap 182, with an upper end of bowl 64 attached to the underside of annular member 78 using bolts 110. Typically, side portion 66 is disposed in annular gap 182, spaced apart from angled member 80.

Figure 5:
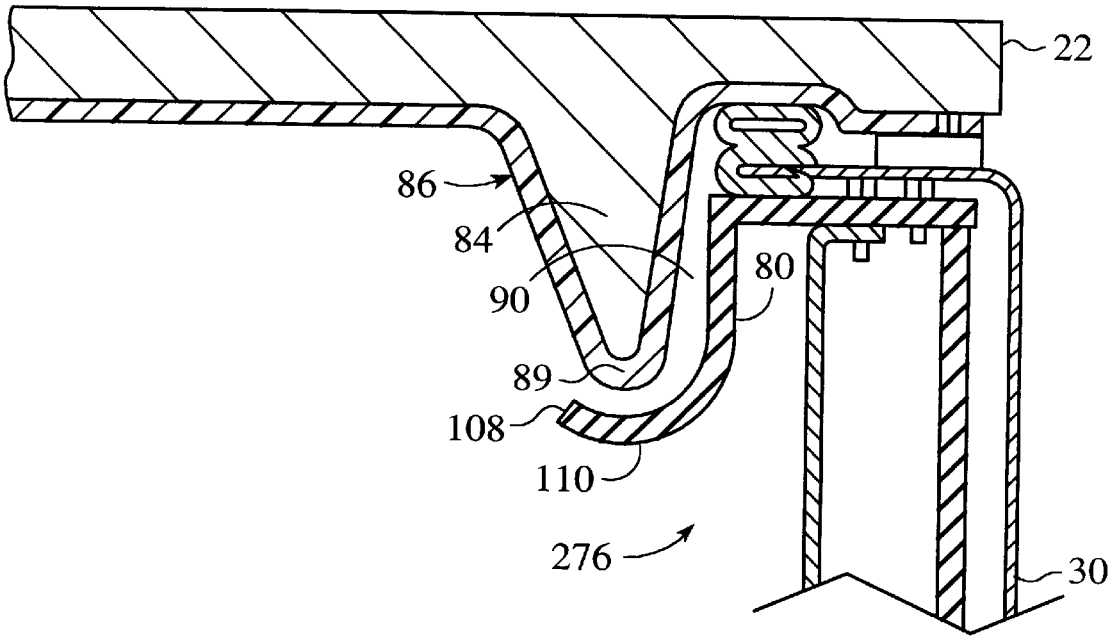
FIG. 5 is a detailed view of the trap shown in FIG. 3, in accord with an alternate embodiment.

Referring also to FIG. 5, trap 276 may include an angled member that has a profile matching annular baffle 84. As shown, trap 276 includes angled member 80, which terminates in a rounded portion 108 having a nadir 110 disposed opposite to base 89. Rounded portion 108 curves upwardly from a nadir 110 toward lid 22, spaced apart from inner surface 86, with baffle 84 terminating proximate to nadir 110. In this fashion, angled member 80 is considered to have a profile matching a contour of baffle 84. However, rounded portion may be formed to terminate proximate to nadir 110. The would prevent debris, deflected from inner surface 86 from being directed into channel 90.

Figure 6:
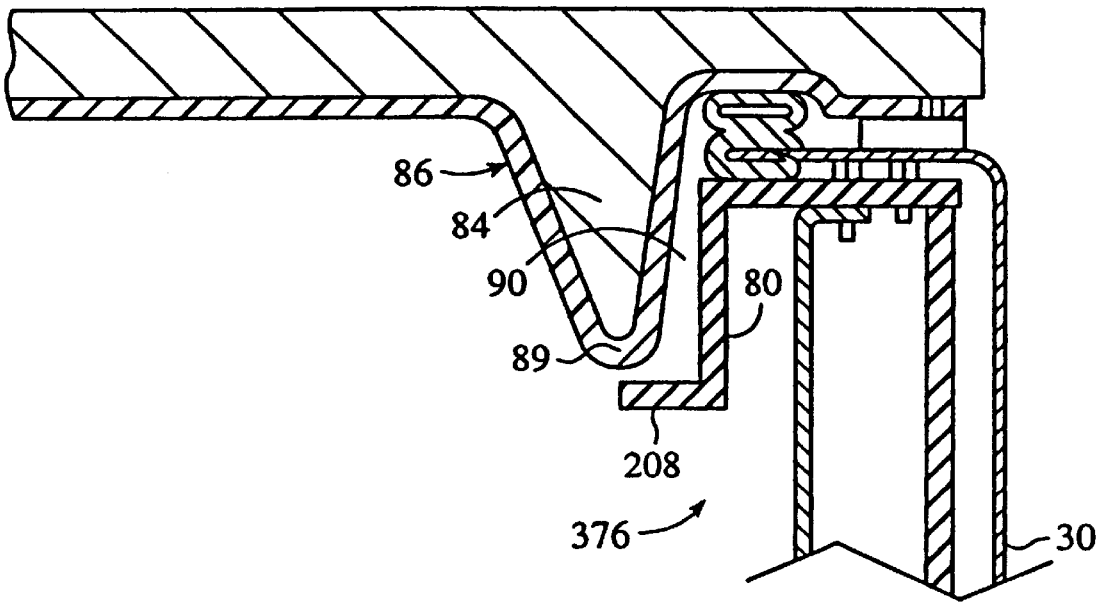
FIG. 6 is a detailed view of the trap shown in FIG. 3, in accord with a second alternate embodiment.

Referring also to FIG. 6, trap 376 is shown with angled member 80 terminating in a cross member 208, which extends perpendicular thereto. Cross member 208 may extend as far as desired toward axis 48. However, it is preferred that cross member 208 terminate opposite to base 89. This configuration also prevents debris, deflected from inner surface 86, from being directed into channel 90.

Figure 7:
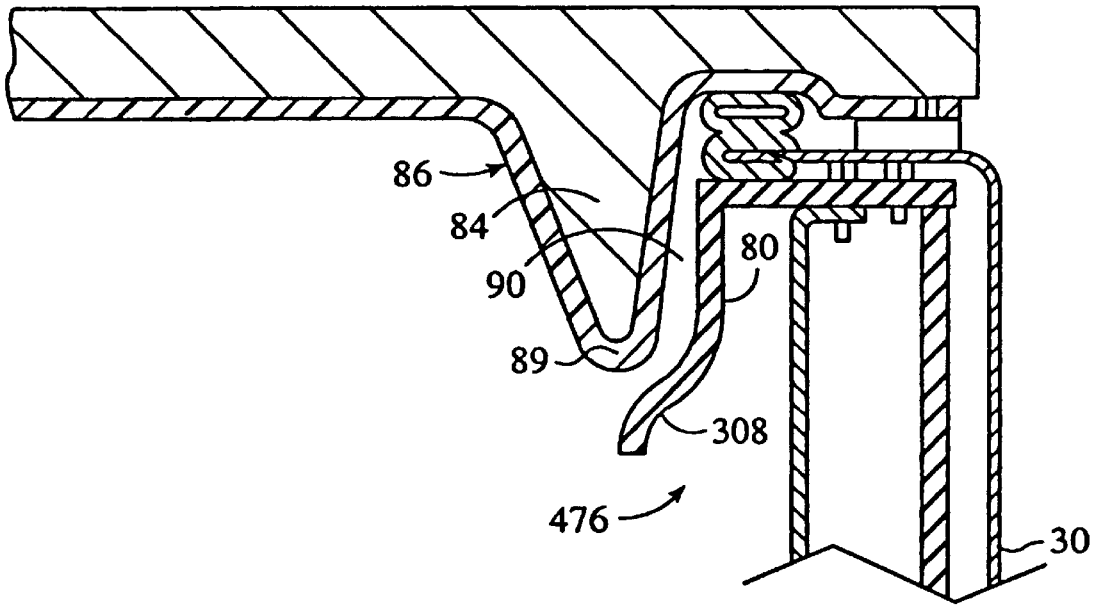
FIG. 7 is a detailed view of the trap shown in FIG. 3, in accord with a third alternate embodiment.

Referring also to FIG. 7, an additional design for trap 476 comprises of angled member 80 terminating depending portion 308 that curves downwardly toward bottom wall 14. Depending portion 308 is attached to angled member 80 at a point opposite to base 89. As with the aforementioned configurations, depending portion 308 also serves to prevent debris, deflected from inner surface 86, from being directed into channel 90.

Figure 8:
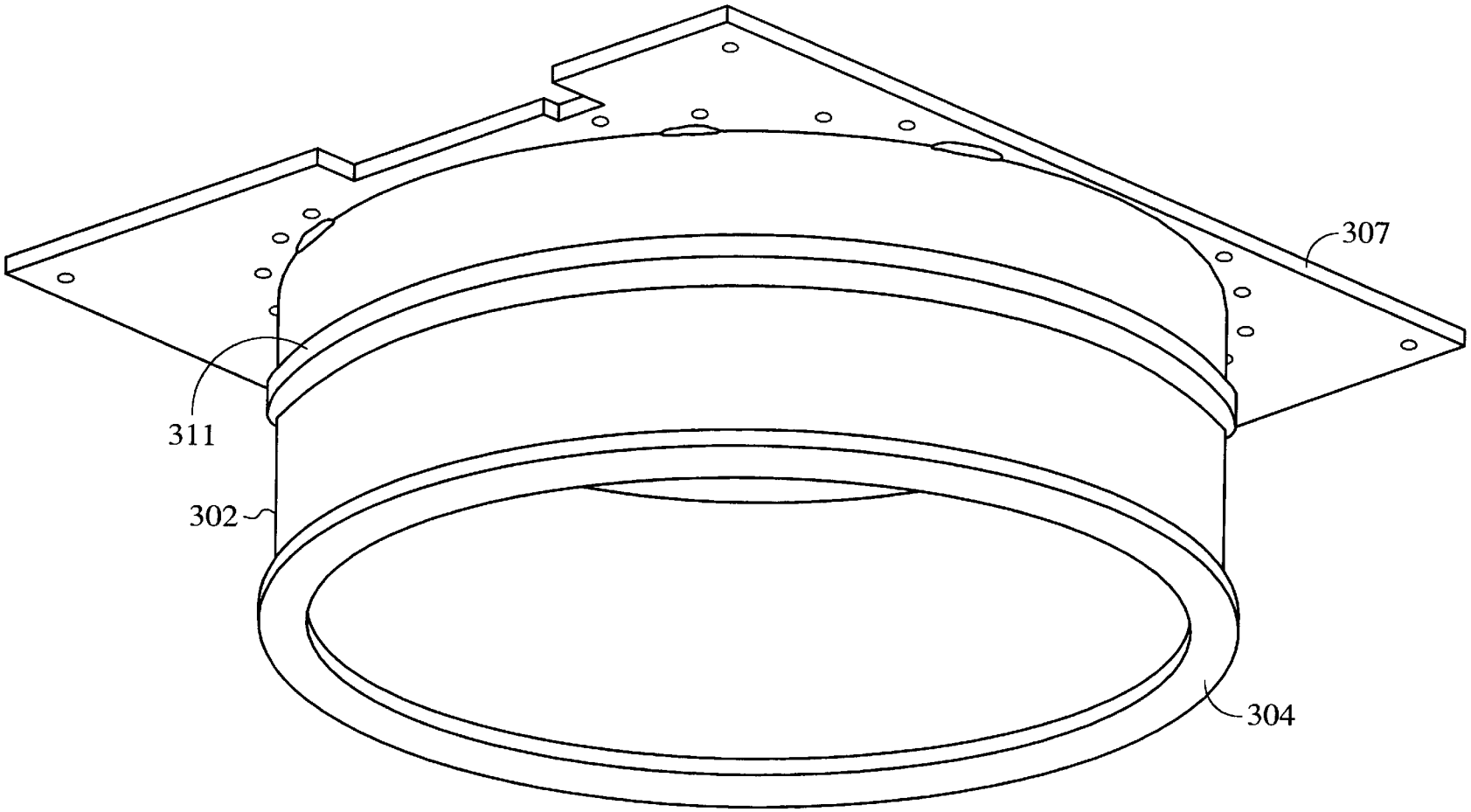
FIG. 8 is a perspective view of the barrier shown in FIG. 4, in accord with an alternate embodiment.

Referring also to FIG. 8, an alternate embodiment of annular fender 302 includes a gusset 311 attached to, and circumferentially disposed about, annular fender 302. Gusset 311 is positioned between top plate 307 and annular flange 304 of annular fender 302, located opposite to top plate 307. The hoop strength associated with gusset 311 prevents fender 302 from stretching or elongating when shrapnel impacts with fender 302. Gusset 311 may be used in lieu of annular flange 304, or in conjunction with annular flange 304.

Figure 9:
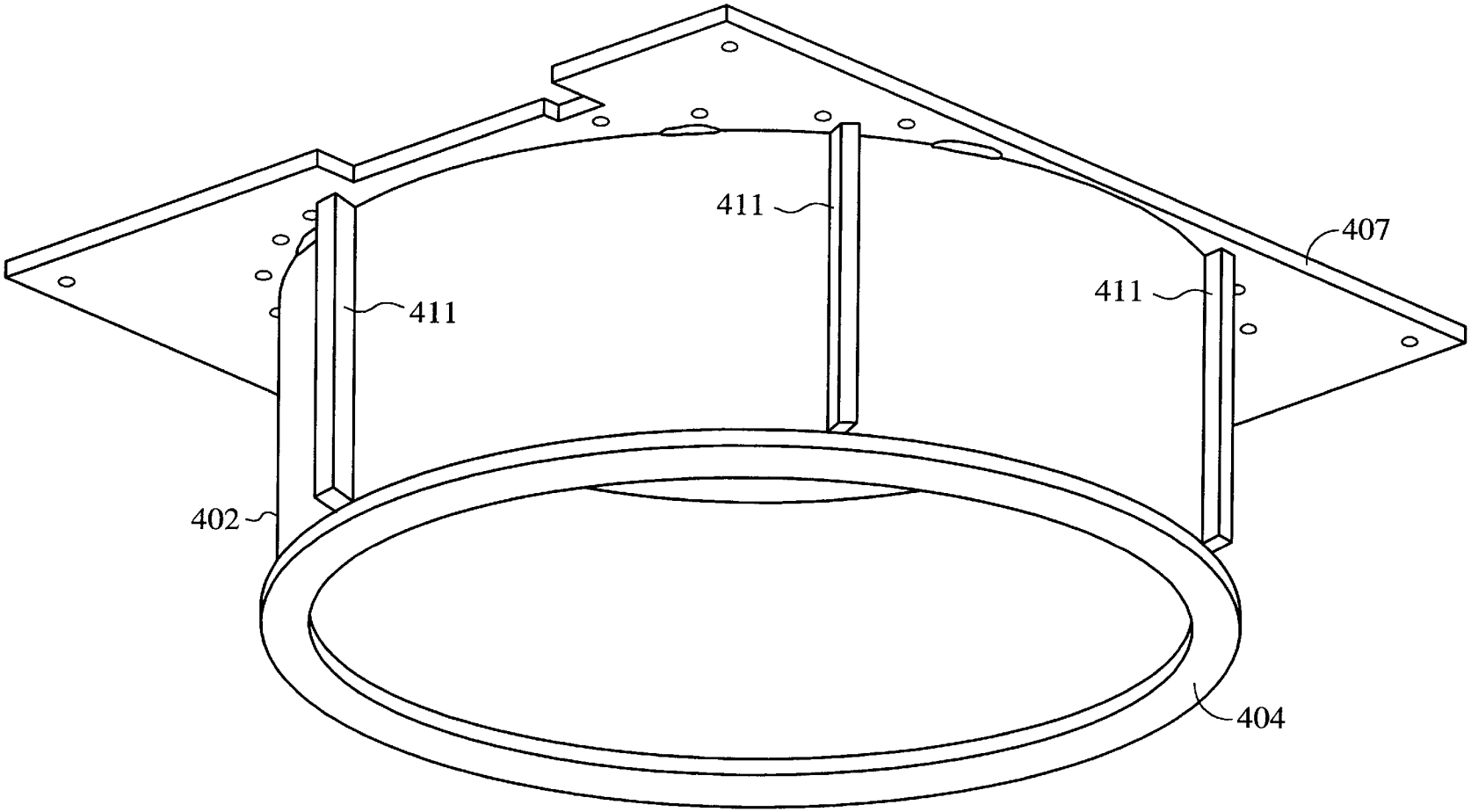
FIG. 9 is a perspective view of the barrier shown in FIG. 4, in accord with a second alternate embodiment.

Referring also to FIG. 9, annular fender 402 is shown having vertical gussets 411. Vertical gussets 411 extend from top plate 407 to the terminus 412 of annular fender 402. Vertical gussets 411 may rest against annular fender 402 to prevent undue stretching and elongation, as discussed above with respect to FIG. 8. Vertical gussets 411, however, may hinder the plastic deformation of annular fender 402. Vertical gussets 411 may, therefore, extend from top plate 407 adjacent to annular fender 402, so as to be spaced-apart from the annular fender 402, terminating proximate to annular flange 404. This design would facilitate plastic deformation, while preventing undue stretching of annular fender 402. Vertical gussets 411 may be used in lieu of either the annular flange or the circumferential gusset. Alternatively, vertical gussets 411 may be used in conjunction with either the annular flange, the circumferential gusset, or both.

Figure 10:
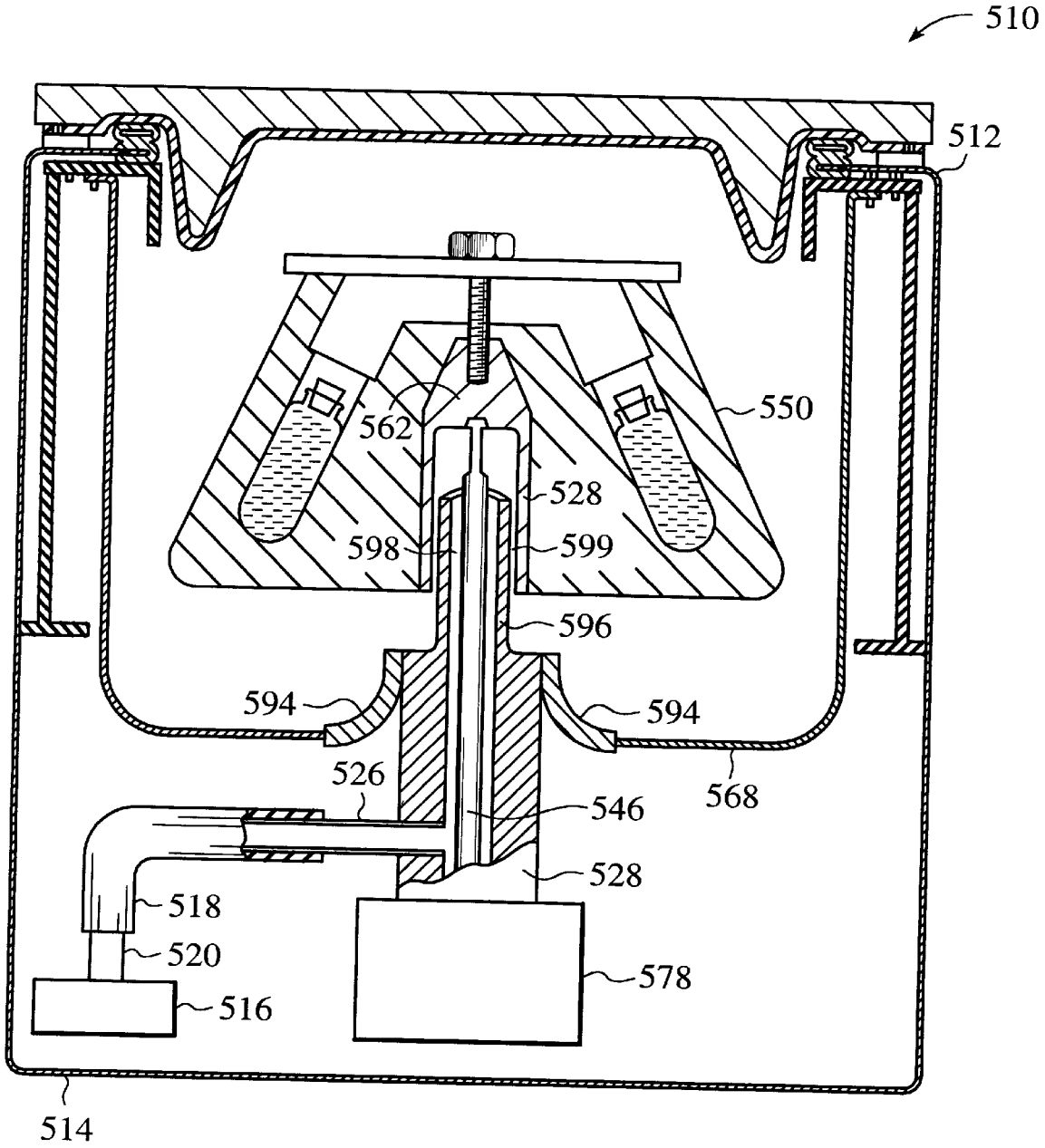
FIG. 10 is a side sectional view of the present invention incorporated in a centrifuge adapted to provide an evacuated chamber.

Referring also to FIG. 10, although the containment system has been described for use in a non-evacuated centrifuge having a swinging bucket rotor 50, the same may employed in an evacuated centrifuge 510. Additionally the containment system may be used with a fixed angle rotor 550. The features of evacuated centrifuge 510 may be the same in all respects as those in the non-evacuated centrifuge described above in FIGS. 1, 2 and 3, except that pressure of the atmosphere within the enclosed chamber of the housing 512 may be controlled by operation of a vacuum pump 516. To that end, a conduit 518 is connected to a fitting 520 that extends from vacuum pump 516. At the opposite end of conduit 518, the same is frictionally fit to a fitting 526 of a sleeve 528. Sleeve 528 has a lower and larger diameter portion that extends coaxially with drive shaft 546 to penetrate terminus 568 of bowl 564. A vacuum seal 594 is connected, at terminus 568, to sleeve 528 to prevent leakage of air into the enclosed chamber of bowl 564 after the evacuation of air therefrom. A reduced diameter portion 596 of sleeve 528 extends into a downwardly depending skirt 528 of hub 562. Thus, a first annular passageway 598 is formed between the drive shaft 546 and the upper surface of the sleeve 528. A second annular passageway 599 is formed between the downwardly depending cylindrical skirt 528 of hub 562 and the outside diameter of the portion 596 of the sleeve 528. Air evacuation from the centrifuge chamber is directed upwardly into the second annular passageway 599 and then downwardly into the first annular passageway 598, whereafter evacuated air is channeled to the vacuum pump 522. As shown in FIG. 10, the motor 578 is also evacuated.

We claim:

1. A containment system for a centrifuge including a lid and a housing, said housing having side walls and a bottom wall, extending between said side walls, defining a chamber with an opening, said opening disposed opposite to said bottom wall, with said lid movably attached to said housing to selectively cover said opening, said system comprising:

a gasket disposed between said lid and said housing, said gasket adapted to provide fluid-tight containment between said lid and said housing upon said lid being positioned to cover said opening; and a first annular member disposed within the housing within the side walls, of the housing terminating in a free end, and a second annular member inward of the side walls of the housing, extending downwardly beyond the free end of the first annular member, toward said bottom wall, thereby forming a cylindrical barrier between the first annular member and its side walls, spaced apart from the free end of the first annular member, the first and second annular members forming a trap partially shielding the gasket preventing debris, traveling away from said bottom wall, from impinging upon said gasket.

2. The containment system as recited in claim 1 wherein said lid includes an annular recess positioned to receive said gasket upon said lid covering said opening.

3. The containment system as recited in claim 1 wherein said lid includes an annular baffle extending downwardly therefrom toward said bottom wall, with said baffle adapted to seat proximate to said trap upon said lid covering said opening.

4. The containment system as recited in claim 3 wherein said first annular member terminates in a rounded portion curving upwardly, from a nadir, toward said lid and angled away from said side walls, with said annular baffle terminating proximate to said nadir.

5. The containment system as recited in claim 3 wherein said first annular member has a profile matching a contour of said baffle.

6. The containment system as recited in claim 3 wherein said opening is round and further including a skirt circumferentially disposed about said opening, between said lid and said periphery, said lid including an annular recess positioned between said baffle and said skirt and adapted to receive said gasket upon said lid covering said opening.

7. The containment system of recited in claim 1 wherein said barrier is adapted to deform upon impact with debris.

8. The containment system as recited in claim 1 wherein said barrier terminates in a flange, with said barrier adapted to deform upon impact with debris while said flange is adapted to maintain a constant spacing distance between non-deformed portions of said barrier and said side walls.

9. A containment system for a centrifuge comprising:

a housing having a bottom and side walls extending therefrom terminating in a opening, said opening having a periphery positioned opposite to said bottom;

a bowl disposed within said opening, defining a chamber, said bowl having a side portion extending from said periphery toward said bottom wall forming a terminus disposed opposite to said opening;

a lid movably attached to said housing to selectively cover said opening;

seal means, disposed between said lid and said periphery, for providing fluid-tight containment therebetween, upon said lid being positioned to cover said opening;

a first annular member extending from said periphery inwardly toward the interior of said bowl, terminating in a free end and a second annular member inward of the side of the housing and spaced apart from the free end of the first annular member; and the first and second annular members having a spaced apart region extending toward said bottom wall with the second annular member extending downwardly from near the side portion of the bowl and the free end of the first annular member forming a trap effective as a decelerating means for decelerating matter traveling outwardly from said chamber toward said housing.

10. The containment system as recited in claim 9 wherein said decelerating means includes an annular baffle extending downwardly from said lid, with said baffle adapted to seat proximate to said side portion upon said lid covering said opening.

11. The containment system as recited in claim 10 wherein said periphery is round and said first annular member extends toward said bottom wall in spaced relation with respect to said side portion forming a gap therebetween.

12. The containment system as recited in claim 11 wherein said first annular member terminates in a rounded portion curving upwardly, from a nadir, toward said lid and angled away from said side walls, with said annular baffle terminating proximate to said nadir.

13. The containment system as recited in claim 11 wherein said first annular member has a portion which extends perpendicular to said side walls and said second annular member is joined to said first annular member.

14. The containment system as recited in claim 13 wherein said second annular member is a cylindrical barrier extending toward said bottom wall between said first annular member and said side walls.

15. The containment system as recited in claim 14 wherein said second annular member is adapted to deform upon impact with debris.

16. The containment system as recited in claim 14, wherein said barrier terminates in a flange positioned proximate to said terminus of said bowl, with said barrier adapted to deform upon impact with debris while said flange is adapted to maintain a constant spacing distance between non-deformed portions of said barrier and said side walls.

17. A containment system for a centrifuge having a lid, a rotor, a bowl and a housing, with said housing having side walls and a bottom wall extending between said side walls perpendicular thereto, defining a chamber with an opening, said opening disposed opposite to said bottom wall and having a periphery, with said bowl disposed within said chamber proximate to said periphery and having a side portion extending therefrom toward said bottom wall forming a terminus disposed opposite to said opening, said rotor being disposed within said bowl with said lid movably attached to said chamber to selectively cover said opening, said system comprising:

seal means, disposed between said lid and said side walls, for providing said chamber with fluid-tight containment between said lid and said periphery upon said lid being positioned to cover said opening, defining a final seating position;

an annular member extending from said periphery inwardly toward an interior of said chamber, terminating in an angled member, said angled member extending toward said bottom wall in spaced relation with respect to said side walls forming a gap therebetween, with said annular member, said angled member and said gap defining a trap means, disposed between said rotor and said lid, for preventing debris traveling away from said bottom wall toward said trap means from impinging upon said seal means; and an annular baffle extending downwardly from said lid, with said baffle adapted to seat proximate to said angled member upon said lid reaching said final seating position.

18. The containment system as recited in claim 17 wherein said lid includes an annular recess positioned to receive said seal means upon said lid reaching said final seating position.

19. The containment system as recited in claim 18 further including a cylindrical barrier extending from said annular member toward said bottom wall between said angled member and said side walls, with said barrier being spaced apart from said side walls and terminating in a flange positioned proximate to said terminus of said bowl, said barrier adapted to deform upon impact with debris while said flange is adapted to maintain a constant spacing distance between non-deformed portions of said barrier and said side walls.

* * * * *